United States Patent [19]

Wojciechowski

[11] 4,165,894

[45] Aug. 28, 1979

[54] SPRING LOADED LOCKING ASSEMBLIES FOR SLIDING WINDOWS AND THE LIKE

[75] Inventor: Felix Wojciechowski, Rockford, Ill.

[73] Assignee: Amerock Corporation, Rockford, Ill.

[21] Appl. No.: 856,251

[22] Filed: Dec. 1, 1977

[51] Int. Cl.[2] ..... E05C 5/00

[52] U.S. Cl. ..... 292/7; 292/336.3; 292/356

[58] Field of Search ..... 292/5-7, 292/36, 40, 34, 336.3, 33, 66, 64, 173, 352, 356

[56] References Cited

U.S. PATENT DOCUMENTS

| | | | |
|---|---|---|---|
| 605,919 | 6/1898 | Sayre | 292/7 |
| 682,117 | 9/1901 | Sayre | 292/7 |
| 2,427,909 | 9/1947 | Howell | 292/356 X |
| 3,843,173 | 10/1974 | Harrell | 292/7 |

FOREIGN PATENT DOCUMENTS

| | | | |
|---|---|---|---|
| 91056 | 6/1961 | Denmark | 292/356 |

OTHER PUBLICATIONS

Amerock Corporation, Drawing No. 60-V-7180, Mar. 22, 1971.

*Primary Examiner*—Roy D. Frazier
*Assistant Examiner*—William E. Lyddane
*Attorney, Agent, or Firm*—Leydig, Voit, Osann, Mayer & Holt, Ltd.

[57] ABSTRACT

A spring-loaded lock assembly for a window or other closure member includes a pair of elongated locking rods carried on the closure member for longitudinal movement to permit the outer ends of the rods to be advanced and retracted relative to cavities in the frame for the closure member. A handle receives the inner ends of the rods and advances and retracts the rods in the longitudinal direction in response to rotational movement of the handle to lock and unlock the closure member. A unitary base member fastened to the closure member supports the handle for rotational movement and forms two pairs of integral stops for limiting the rotational movement of the handle in opposite directions about its axis. Biasing means are carried on the locking rods for urging the locking rods toward the respective stops. The base member includes means for holding the inner ends of the locking rods in the handle while permitting handle rotation. The base member also forms spring fingers for capturing the handle on the base member.

1 Claim, 2 Drawing Figures

SPRING LOADED LOCKING ASSEMBLIES FOR SLIDING WINDOWS AND THE LIKE

SUMMARY OF THE INVENTION

The present invention relates generally to lock assemblies and, more particularly, to an improved lock assembly for windows or other closure members mounted in a frame.

It is a primary object of the present invention to provide an improved spring-loaded lock assembly which has a small number of parts which can be easily and quickly assembled.

A further object of the invention is to provide such an improved lock assembly which can be efficiently and economically manufactured and installed at high production rates.

Other objects and advantages of the invention will be apparent from the following detailed description and the accompanying drawings.

Figure 1:
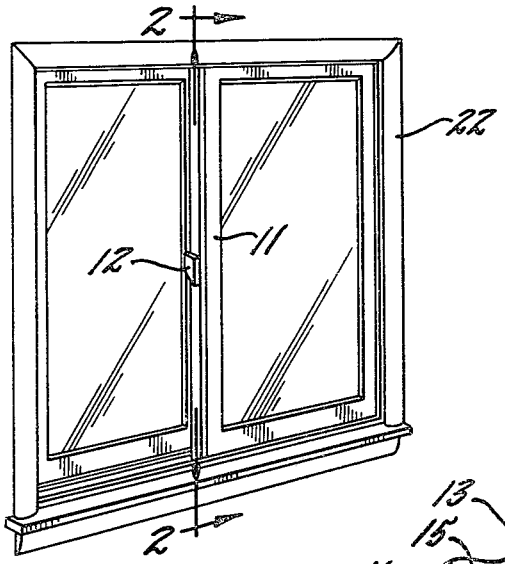
FIG. 1 illustrates a spring-loaded lock assembly embodying the invention and mounted on a sliding window.
Figure 3:
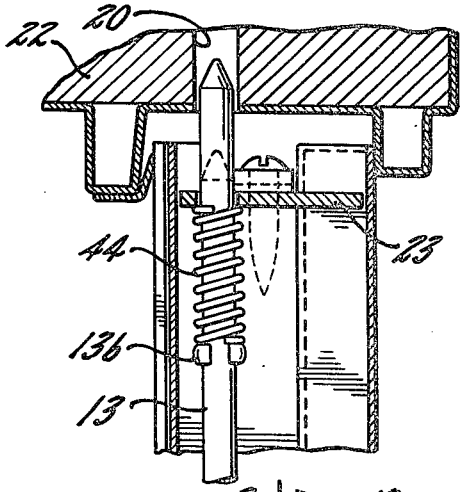
FIG. 3 is a section taken generally along line 3—3 in FIG. 2.
Figure 3:
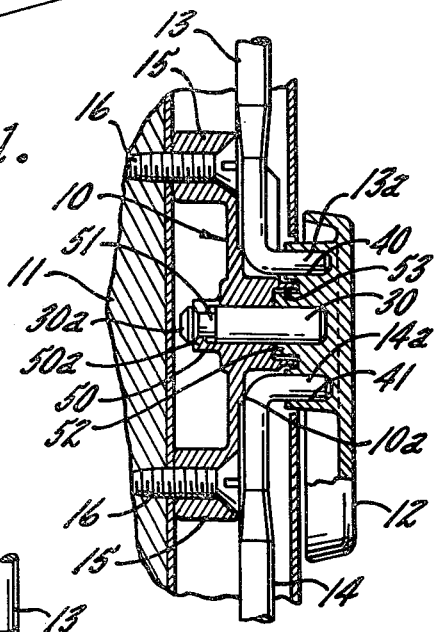
Figure 4:
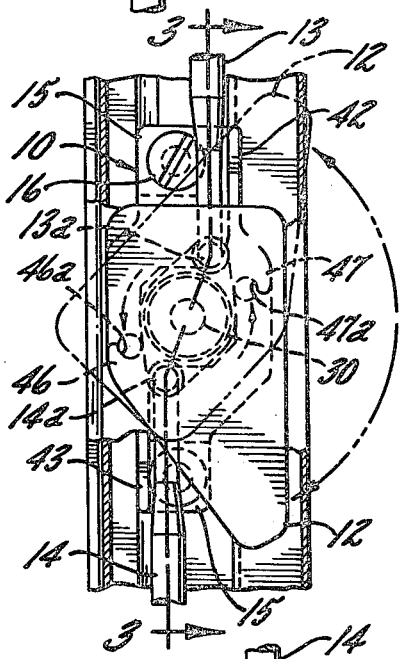
FIG. 4 is an exploded perspective view of the lock assembly shown in FIGS. 1-3.
Figure 4:
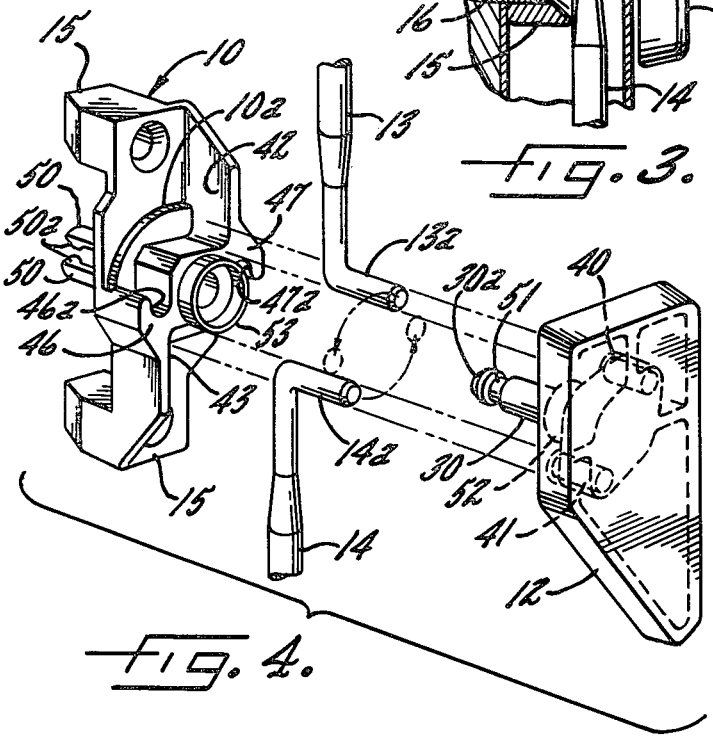

While the invention will be described in connection with certain preferred embodiments, it will be understood that it is not intended to limit the invention to these particular embodiments. On the contrary, it is intended to cover all alternatives, modifications and equivalent arrangements as may be included within the spirit and scope of the invention as defined by the appended claims.

DETAILED DESCRIPTION OF THE INVENTION

The illustrative lock assembly shown in the drawings includes a base member 10 secured to a sliding window 11 and forming a journal for a handle 12 fastened to the inner ends of a pair of elongated locking rods 13 and 14. While the illustrative lock assembly will be described in connection with a sliding window, it will be understood that similar lock assemblies could be used with other closure members such as sliding doors and the like. In order to attach the base member 10 to the window 11 the base member forms a pair of integral bosses 15 which are apertured to receive a pair of screws 16 which can be threaded into the sash of the window.

Figure 2:
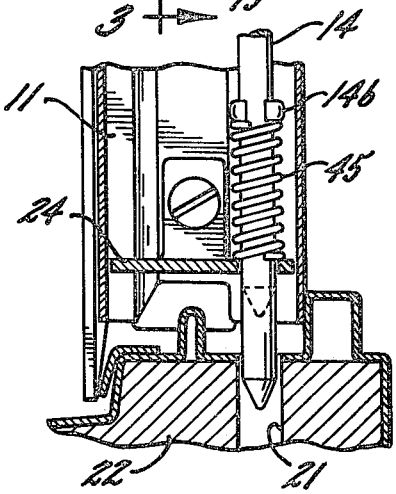
FIG. 2 is an enlarged vertical section taken generally along the line 2—2 in FIG. 1, with fragments thereof removed.

For the purpose of locking and unlocking the window 11, the elongated locking rods 13 and 14 are carried on the window for longitudinal movement so that the outer ends of the rods may be telescoped in and out of complementary cavities 20 and 21 formed in the frame 22. As shown most clearly in FIG. 2, the window 11 is locked to the frame 22 when the outer ends of the rods 13 and 14 are advanced into the respective cavities 20 and 21. Conversely, to unlock the window 11 for sliding movement within the frame 22, the locking rods are retracted out of the cavities 20, 21. In FIG. 2 the rods 13 and 14 are illustrated in their retracted or "unlocked" positions in dashed lines, and their advanced or "locked" positions are shown in solid lines. To permit longitudinal movement of the rods 13 and 14 while holding them captive on the window, the outer end portions of the rods extend through complementary apertures in a pair of brackets 23 and 24 fastened to the window sash. These brackets 23 and 24 align the outer ends of the rods 13 and 14 with the respective cavities 20 and 21 when the window is completely closed.

To advance and retract the locking rods 13 and 14 through the brackets 23 and 24, the handle 12 is turned about an axis defined by a stub shaft 30 journaled in the base member 10. More specifically, the inner ends of the rods 13 and 14 are fastened to the handle 12 at points spaced laterally from the axis of rotation of the handle so that rotational movement of the handle 12 wIll advance or retract the rods in the longitudinal direction. Thus, as the handle 12 is turned in the clockwise direction as viewed in FIG. 2, the locking rods 13 and 14 are both advanced to their locked positions. Conversely, when the handle 12 is rotated in the counterclockwise direction as viewed in FIG. 2, the locking rods 13 and 14 are retracted to their unlocked positions.

In accordance with one important aspect of the present invention, a unitary base member supports the handle for rotational movement while holding the inner ends of the rods captive in the handle, while also forming first and second pairs of stops which limit the rotational movement of the handle in first and second directions to position the rods in their respective locked and unlocked positions. Thus, in the illustrative embodiment, the inner ends **13*a* and 14*a* of the locking rods are bent laterally to their axes and extend into a pair of complementary recesses 40 and 41 in the handle 12. The bent inner ends of the rods are held captive in these recesses 40 and 41 by the central portion of the base member 10 which bears against both rod 13 and 14. To limit rotational movement of the handle 12 in the clockwise direction as viewed in FIG. 2 so that advancing movement of the locking rods 13 and 4 is stopped in the desired locked position, the unitary base member 10 forms a first pair of stops 42 and 43 which consist of a pair of integral ribs extending along the side edges of the base member. As the handle 12 is turned in the clockwise direction, the inner ends 13*a* and 14*a* of the locking rods abut this first pair of stops 42 and 43 when the rods are in the advanced position shown in solid lines in FIG. 2. In order to urge the locking rods against the stops 42 and 43 in this advanced position, compressed coil springs 44 and 45 are carried on the respective rods 13 and 14 between tabs 13*b* and 14*b* on the rods and the corresponding brackets 23 and 24. When the rods are in their locked positions, these springs 44 and 45 urge the rods against the stops 42 and 43, thereby insuring a secure lock which cannot be loosened by jarring or shaking the window. This inward biasing force on the rods can, of course, be easily overcome by manual rotation of the handle 12** in the counterclockwise direction.

For the purpose of limiting rotational movement of the handle in the counterclockwise direction, the base member 10 forms a second pair of integral stops 46 and 47. This second pair of stops consist of a pair of arcuate ribs which extend from the side edge of the base member 10 toward the axis of the handle, forming notches **46*a* and 47*a* for receiving and holding the inner ends 13*a* and 14*a* of the rods when the rods are in their retracted, unlocked positions. In this position, the compression springs 44 and 45 urge the locking rods against the stops 46 and 47 to hold the rods in the retracted position during sliding movement of the window. For the purpose of minimizing friction between the base member 10 and the rods 13 and 14 during rotational movement of the handle 12, the member 10 forms raised lands 10***a* upon which the elbows of the rods 13 and 14 ride during pivotal movement thereof.

It should be noted that during advancing and retracting movement, the inner end of each rod passes through a line which extends from the outer end of the rod to the axis of rotation of the handle 12 so that the single spring 44 or 45 biases the rod in opposite directions around the handle axis. More particularly, when the rod is in the retracted position, the spring 44 or 45 biases the rod in the counterclockwise direction with respect to the handle axis, and when the rod is rotated to the advanced position the same spring biases the rod in the clockwise direction with respect to the handle axis.

In accordance with a further aspect of the invention, the unitary base member 10 includes integral holders for capturing the handle on the base member. Thus, in the illustrative embodiment the base member 10 forms a plurality of spring fingers 50 which grip the stub shaft 30 of the handle 12. As the shaft 30 is advanced through the central aperture of the base member 10, a beveled head 30*a* on the end of the shaft 30 deflects the spring fingers outwardly until beads 50*a* on the inside surfaces of the spring fingers 50 clear the crest of the beveled head 30*a*. The beads 50*a* then slide inwardly over the beveled head 30*a*, and the inherent resiliency of the spring fingers 50 causes them to snap into a circumferential recess 51 spaced inwardly from the end of the shaft 30, thereby locking the shaft (and thus the handle) to the base member 10.

For supporting and stabilizing the handle 12 on the base member 10 during rotational movement of the handle, the handle includes a hub 52 which fits into an annular collar 53 formed by the base member 10. The top edge of the collar 53 nests in an annular groove formed by the hub 52, with the opposed walls of the hub and collar forming telescoping annular surfaces which guide and stabilize the handle 12 on the base member 10 while permitting rotational movement of the handle.

It will be apparent from the foregoing detailed description that the present invention provides a spring-loaded lock assembly for windows and other closure member that has only a small number of parts which can be easily and quickly assembled so that the entire lock assembly can be efficiently and economically manufactured and installed at high production rates.

It will be appreciated by those skilled in the art that various changes and modifications can be made in the spring loaded lock assembly disclosed herein without departing from the spirit and scope of the invention.

I claim:

1. A lock assembly for a window or other closure member mounted within a frame, said lock assembly comprising:

a pair of elongated locking rods carried on the closure member for longitudinal movement to permit the outer ends of said rods to be advanced and retracted relative to cavities in the frame, the inner ends of said rods being bent laterally to the axes of the rods and forming elbows, a handle forming recesses for receiving the inner ends of said rods for advancing and retracting said rods in the longitudinal direction in response to rotational movement of the handle to lock and unlock the closure member and its frame, and a unitary base member fastened to the closure member and supporting said handle for rotational movement while holding the inner ends of said rods captive in said handle, said base member forming, a first pair of stops for limiting the rotational movement of the handle in a first direction to position the outer ends of said locking rods in an advanced position within the cavities in the frame, thereby locking the closure member to the frame, a second pair of stops for limiting the rotational movement of the handle in a second direction to position the outer ends of said locking rods in a retracted position outside the cavities in the frame, thereby unlocking the closure member from the frame, and raised lands upon which the elbows of said rods ride during pivitol movement of said rods to minimize friction between said base member and said rods during pivitol movement, said handle including a stub shaft which forms a circumferential groove spaced inwardly from the end of said shaft and said base member forming a plurality of spring fingers adapted to flex outwardly to clear the end of said shaft and then snap into said groove to capture said handle on said base member, said handle and base member further forming telescoping annular surfaces for stabilizing the handle on the base member while permitting rotational movement of said handle.

* * * * *